US010494208B2

(12) United States Patent
Nakamura

(10) Patent No.: US 10,494,208 B2
(45) Date of Patent: Dec. 3, 2019

(54) SHEET FEEDING DEVICE AND IMAGE FORMING APPARATUS

(71) Applicant: KONICA MINOLTA, INC., Chiyoda-ku, Tokyo (JP)

(72) Inventor: Hajime Nakamura, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/868,017

(22) Filed: Jan. 11, 2018

(65) Prior Publication Data

US 2018/0194578 A1 Jul. 12, 2018

(30) Foreign Application Priority Data

Jan. 12, 2017 (JP) ..... 2017-003068

(51) Int. Cl.

| | |
|---|---|
| ***B65H 3/12*** | (2006.01) |
| ***B65H 1/04*** | (2006.01) |
| ***B65H 7/02*** | (2006.01) |
| ***B65H 5/06*** | (2006.01) |
| ***B65H 5/36*** | (2006.01) |
| ***B65H 29/24*** | (2006.01) |

(52) U.S. Cl.

CPC ..... *B65H 3/128* (2013.01); *B65H 1/04* (2013.01); *B65H 5/062* (2013.01); *B65H 5/36* (2013.01); *B65H 7/02* (2013.01); *B65H 29/245* (2013.01); *B65H 2801/06* (2013.01)

(58) Field of Classification Search

CPC .. B65H 3/124; B65H 3/128; B65H 2406/323; B65H 2406/32; B65H 2404/24; B65H 2404/268

USPC ..... 271/97, 98

See application file for complete search history.

(56) References Cited

U.S. PATENT DOCUMENTS

| | | | | |
|---|---|---|---|---|
| 7,600,748 | B2 * | 10/2009 | Takai | B65H 3/128 271/106 |
| 2015/0239692 | A1 * | 8/2015 | Furuichi | B65H 3/128 271/11 |
| 2018/0150006 | A1 * | 5/2018 | Furuichi | G03G 15/6511 |
| 2018/0327202 | A1 * | 11/2018 | Nakamura | B65H 3/128 |

FOREIGN PATENT DOCUMENTS

JP 2008-308303 A 12/2008

* cited by examiner

*Primary Examiner* — Michael C McCullough

(74) *Attorney, Agent, or Firm* — Buchanan Ingersoll & Rooney PC

(57) ABSTRACT

A sheet feeding device includes: a stacker that stacks sheets of paper; a suction conveyor disposed vertically above the sheets stacked in the stacker for sucking and conveying the sheets; a blower that blows air onto the sheets; and a regulating member disposed on a downstream side of the suction conveyor in a conveyance direction, facing an outlet of the sheets of the suction conveyor and projecting vertically upward, wherein the suction conveyor includes: horizontal portions provided on both ends in a width direction; and a recess provided in an intermediate portion and recessed vertically above the horizontal portions, and a lower limit of a projection height of the regulating member is set so that, when there is a vertical gap between a vertical upper end portion of the regulating member and the horizontal portions, a length of the gap is less than twice a thickness of the sheets.

11 Claims, 9 Drawing Sheets

SHEET FEEDING DEVICE AND IMAGE FORMING APPARATUS

The entire disclosure of Japanese patent Application No. 2017-003068, filed on Jan. 12, 2017, is incorporated herein by reference in its entirety.

BACKGROUND

Technological Field

The present invention relates to an air suction sheet feeding device that has an air blowing mechanism, and an image forming apparatus provided with the sheet feeding device.

Description of the Related Art

Image forming apparatuses such as a copying machine, a printing apparatus, a facsimile apparatus, a printing press, and a multi-function machine are equipped with a sheet feeding device that feeds sheets of paper stacked in a sheet storing unit, one by one. An air suction sheet feeding device that has an air blowing mechanism is an example of a sheet feeding device. The air suction sheet feeding device blows air onto an end surface of a stack of sheets of paper near the top of the stack to cause the sheets of paper to float and separates (sorts) the floated sheets of paper from one another while conveying them with a suction belt (air suction belt).

In the sheet feeding device, a so-called double feed may occur in which subsequent sheets of paper are conveyed together with the first sheet of paper on the top. Thus, for example, JP 2008-308303 A discloses a device to prevent double feeds. JP 2008-308303 A discloses a sheet feeding device that includes a sheet stopping gate which is disposed facing an air suction belt on a sheet conveyance path, and a pawl-like member which is rotatably supported by the sheet stopping gate and against which subsequent sheets of paper abut.

However, when conveying sheets of thick paper with the technology disclosed in JP 2008-308303 A, the pawl-like member rotates due to subsequent sheets of thick paper abutting against the pawl-like member. The technology disclosed in JP 2008-308303 A is thus unfortunately not capable of preventing double feeds when conveying sheets of thick paper.

SUMMARY

In view of the conventional problem described above, it is an object of the present invention to provide a sheet feeding device and an image forming apparatus which are capable of ensuring prevention of double feeds even when conveying sheets of thick paper.

To achieve the abovementioned object, according to an aspect of the present invention, a sheet feeding device reflecting one aspect of the present invention comprises: a stacker that stacks sheets of paper; a suction conveyor disposed vertically above the sheets of paper stacked in the stacker for sucking and conveying the sheets of paper; a blower that blows air onto the sheets of paper sucked by the suction conveyor; and a regulating member disposed on a downstream side of the suction conveyor in a conveyance direction, facing an outlet of the sheets of paper of the suction conveyor and projecting vertically upward, wherein the suction conveyor includes: horizontal portions provided on both ends in a width direction orthogonal to the conveyance direction of the sheets of paper; and a recess provided in an intermediate portion in the width direction and recessed vertically above the horizontal portions, and a lower limit of a projection height of the regulating member is set so that, when there is a vertical gap between a vertical upper end portion of the regulating member and the horizontal portions, a length of the gap is less than twice a thickness of the sheets of paper.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
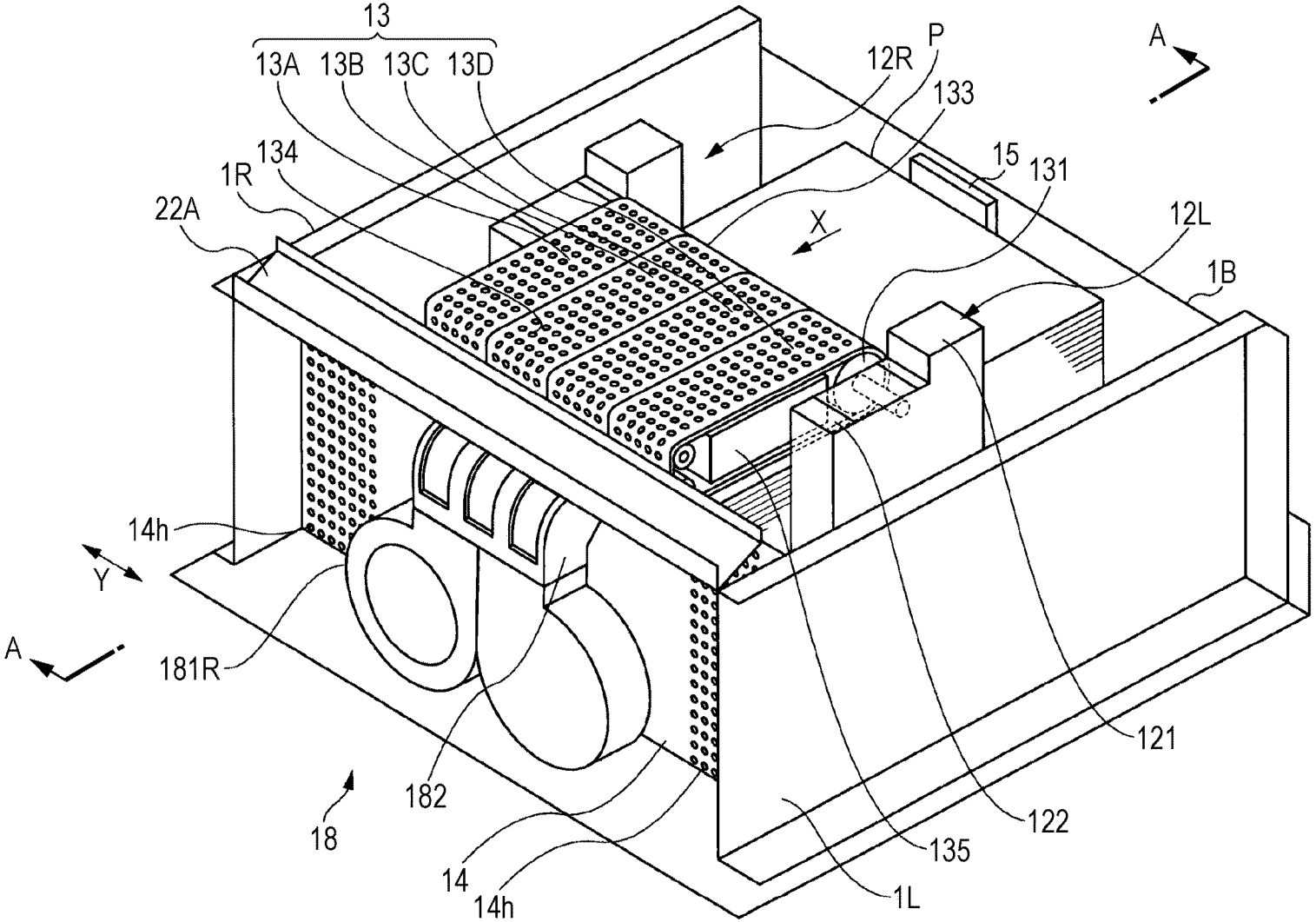
FIG. 1 is a schematic view of a sheet feeding device according to an exemplary embodiment of the present invention.

Hereinafter, one or more embodiments of a sheet feeding device and an image forming apparatus according to the present invention will be described with reference to FIGS. 1 to 12. In the drawings, common components have been given the same reference numbers. However, the scope of the invention is not limited to the disclosed embodiments.

1. EXEMPLARY EMBODIMENTS

1-1. Overall Configuration of a Sheet Feeding Device

Figure 2:
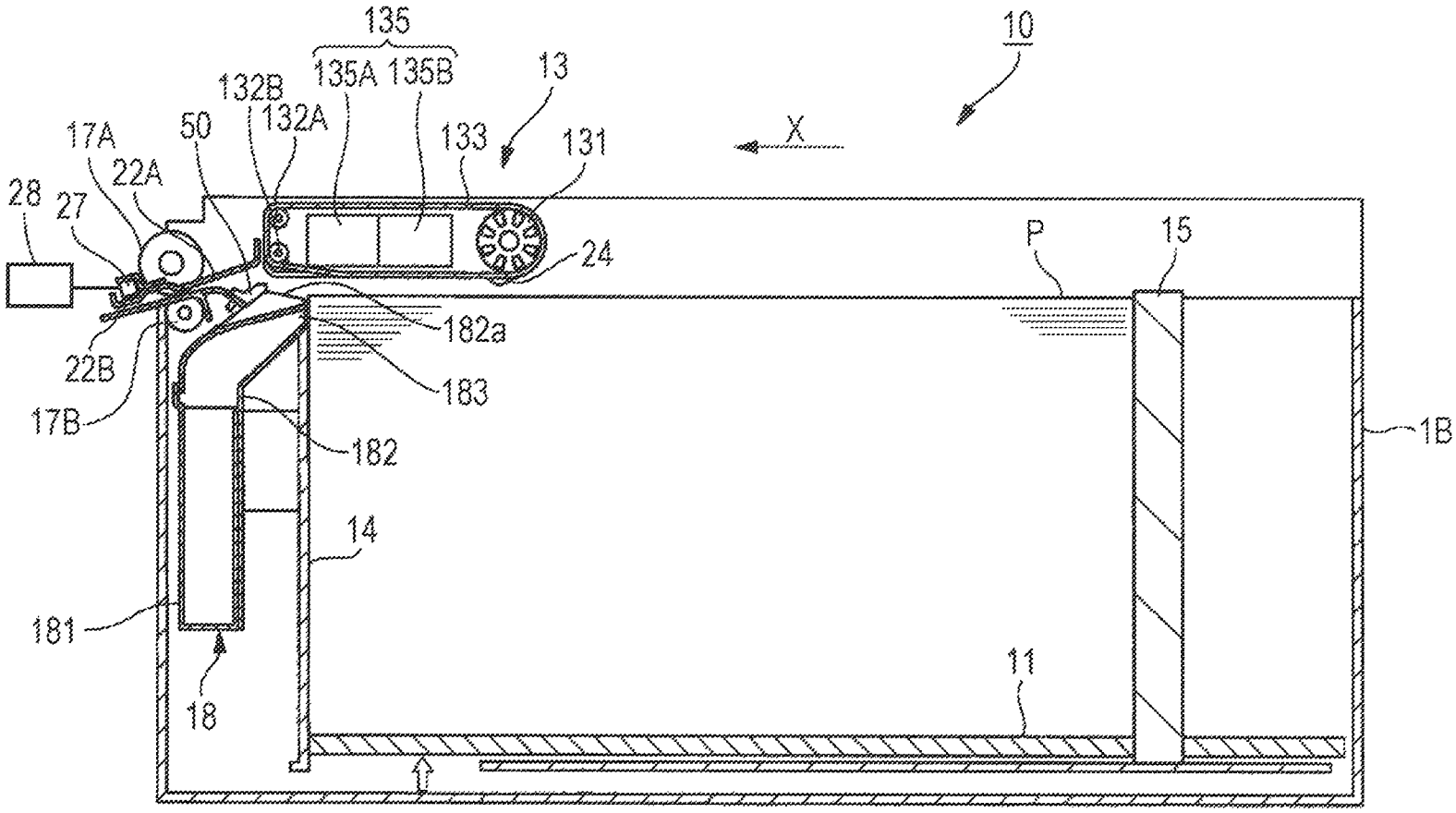
FIG. 2 is a schematic cross-sectional view of the sheet feeding device according to an exemplary embodiment of the present invention along a sheet feed direction thereof.
Figure 3:
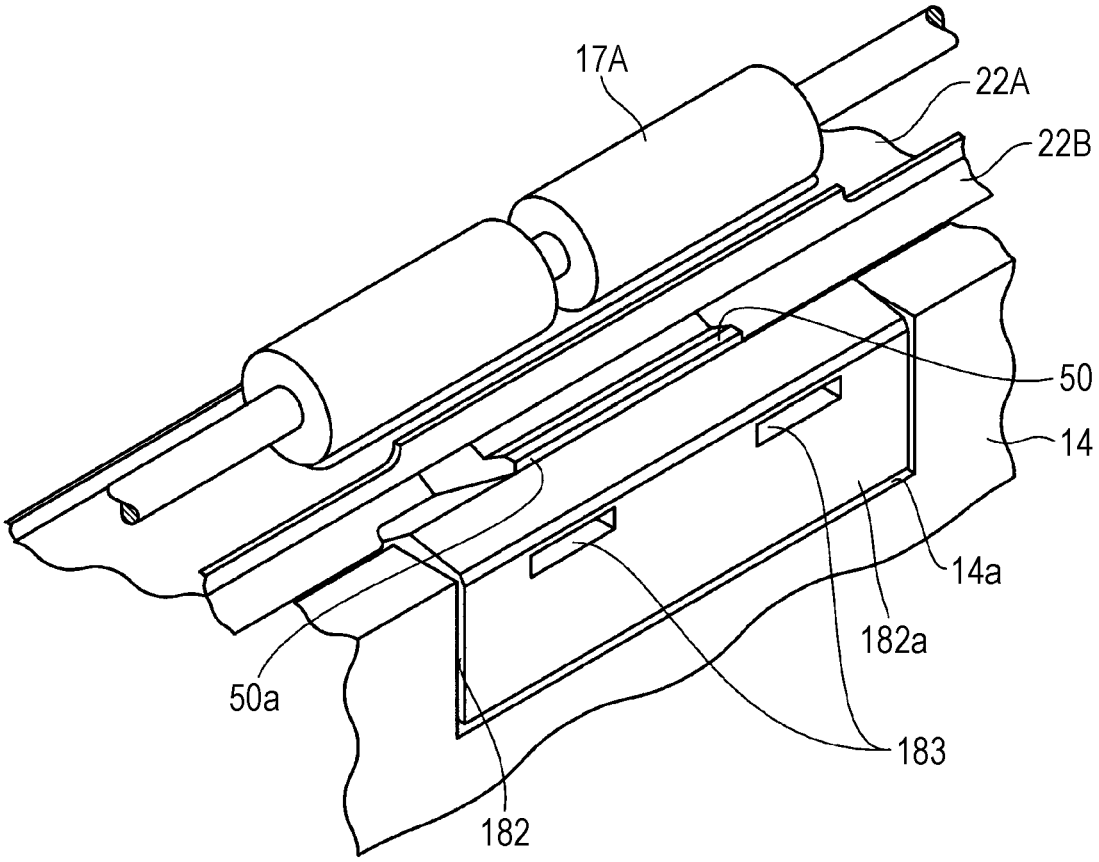
FIG. 3 is a perspective view of the sheet feeding device according to an exemplary embodiment of the present invention, showing the vicinity of air discharge portions.
Figure 4:
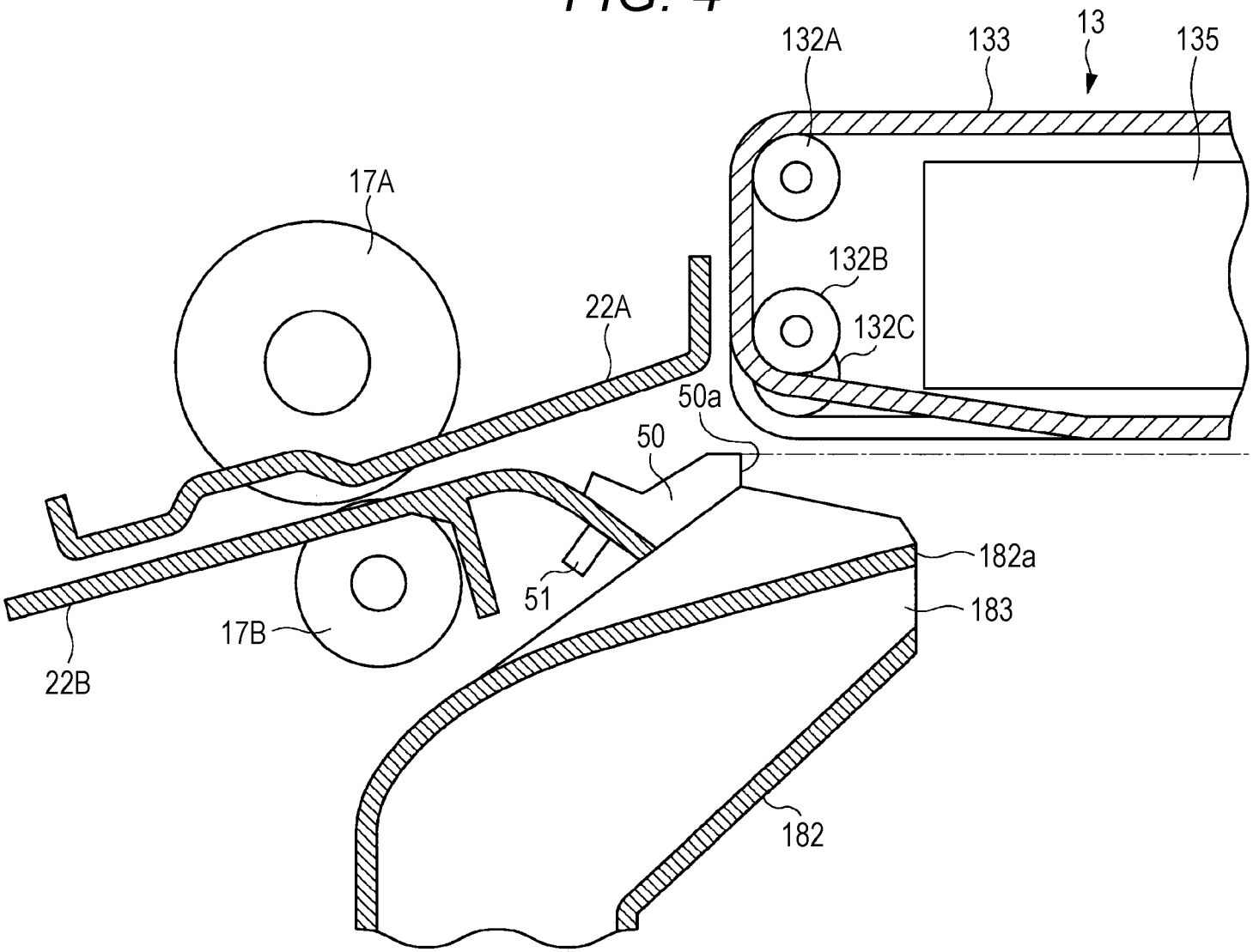
FIG. 4 is a cross-sectional view of the sheet feeding device according to an exemplary embodiment of the present invention, showing the vicinity of the air discharge portions.

The overall configuration of a sheet feeding device according to an exemplary embodiment of the present invention (hereinafter, "present example") will now be described. FIG. 1 is a perspective view of a schematic representation of a sheet feeding device of the present example, and FIG. 2 is a schematic cross-sectional view of the sheet feeding device of the present example along a sheet feed direction thereof. FIGS. 3 and 4 are diagrams of the sheet feeding device of the present example, showing the configuration around air discharge portions.

A sheet feeding device 10 of the present example has an air blowing mechanism that blows air onto sheets of paper P stacked in a plate-shaped paper tray 11 (an example of a sheet stacker) from a sheet end surface, and feeds the sheets of paper P while separating them from one another by blowing air thereonto.

As shown in FIGS. 1 and 2, the sheet feeding device 10 includes the paper tray 11 in which the sheets of paper P are stacked, side wall portions 1L, 1R, a rear wall portion 1B, and a plate-shaped front end regulating member 14. The sheet feeding device 10 also includes a suction conveyor 13, a rear end regulating member 15, a pair of conveyance rollers 17A, 17B, a front end blower 18, a pair of sheet conveyance guide members 22A, 22B, and a regulating member 50.

The paper tray 11 is capable of moving up and down (arrow in FIG. 2) by an elevation mechanism not shown. That is, the sheets of paper P are contained in the paper tray 11 so as to be movable up and down. Side regulating members 12L, 12R are disposed on both sides in a width direction (Y direction), which are lateral sides of the sheets of paper P stacked in the paper tray 11. The side regulating members 12L, 12R are movably mounted in the width direction (direction of arrow Y in FIG. 1) of the sheets of paper P. The side regulating members 12L, 12R regulate both side positions of the sheets of paper P by lightly pressing the sheets of paper P from both sides according to the widths of the sheets of paper P stacked in the paper tray 11.

The side regulating members 12L, 12R basically have the same configuration. The configuration of the side regulating member 12L will be briefly described here. The side regulating member 12L has a stepped apex portion, and a top surface 121 on an upstream side of a conveyance direction of the sheets of paper P, that is, the sheet feed direction (direction of arrow X), is relatively higher than a top surface 122 on a downstream side thereof.

Side blowers not shown are disposed inside the side regulating members 12L, 12R. The side blowers blow air onto the top of the stack of the sheets of paper P from sheet end surfaces from both sides in the direction (Y direction) orthogonal to the conveyance direction (X direction) of the sheets of paper P.

Additionally, as the side blowers are housed inside the side regulating members 12L, 12R, they are capable of moving together with the side regulating members 12L, 12R when the size of the sheets of paper P is changed and the side regulating members 12L, 12R are moved. It should be noted that although the present example has side blowers on both sides of the sheets of paper P, either one of the side blowers may be provided on only one side.

The front end regulating member 14 is disposed on a front end side in the conveyance direction (X direction) of the sheets of paper P stacked in the paper tray 11. The front end regulating member 14 regulates a front end position of the sheets of paper P in the conveyance direction. A plurality of through holes 14*h* are formed on the front end regulating member 14. Additionally, as shown in FIG. 3, an opening 14*a* is formed on a vertical upper end portion of the front end regulating member 14.

The front end blower 18, which is an example of a blower, is disposed on the front end regulating member 14. By being disposed on the front end regulating member 14, the front end blower 18 is disposed on the downstream side in the conveyance direction (X direction) of the sheets of paper P stacked in the paper tray 11. The front end blower 18 is configured, for example, with a blower fan 181 and a duct 182. The sheet feeding device 10 of the present example has, as the blower fan 181, a first blower fan 181L and a second blower fan 181R.

The first blower fan 181L is disposed on one side in the width direction (Y direction) of the sheets of paper P, and the second blower fan 181R is disposed on the other side in the width direction (Y direction) of the sheets of paper P. Hereinafter, the first blower fan 181L and the second blower fan 181R are collectively or without distinction called the blower fan 181.

As shown in FIG. 3, an exit 182*a* of the duct 182 is disposed in the opening 14*a* of the front end regulating member 14. Air discharge portions 183 (examples of a blowing port) are formed on the exit 182*a* of the duct 182.

As shown in FIGS. 2 and 4, the front end blower 18 blows air sent upward from the blower fan 181 out of the air discharge portions 183 by changing the direction of the air with the duct 182. This causes the front end blower 18 to blow the air sent from the blower fan 181 toward the front ends of the sheets of paper P which are stacked and sucked by the suction conveyor 13, to be described later.

A controller controls the drive of the front end blower 18 according to, for example, the size and the basis weight (sheet stiffness) of the sheets of paper P, and the environment. More specifically, under control of the controller, the amount of air blown from the blower fan 181 is controlled according to, for example, the size and the basis weight of the sheets of paper P, and the environment.

Additionally, the rear end regulating member 15 is disposed on a rear end side in the conveyance direction (X direction) of the sheets of paper P stacked in the paper tray 11. The rear end regulating member 15 is movably mounted in the conveyance direction of the sheets of paper P, and regulates the rear end position of the sheets of paper P in the conveyance direction by lightly pressing the sheets of paper P from the rear end side.

As shown in FIGS. 1 and 2, the suction conveyor 13 is disposed above the front end of the sheets of paper P in the conveyance direction (X direction). The suction conveyor 13 has a first conveyor part 13A, a second conveyor part 13B, a third conveyor part 13C, and a fourth conveyor part 13D.

Figure 5:
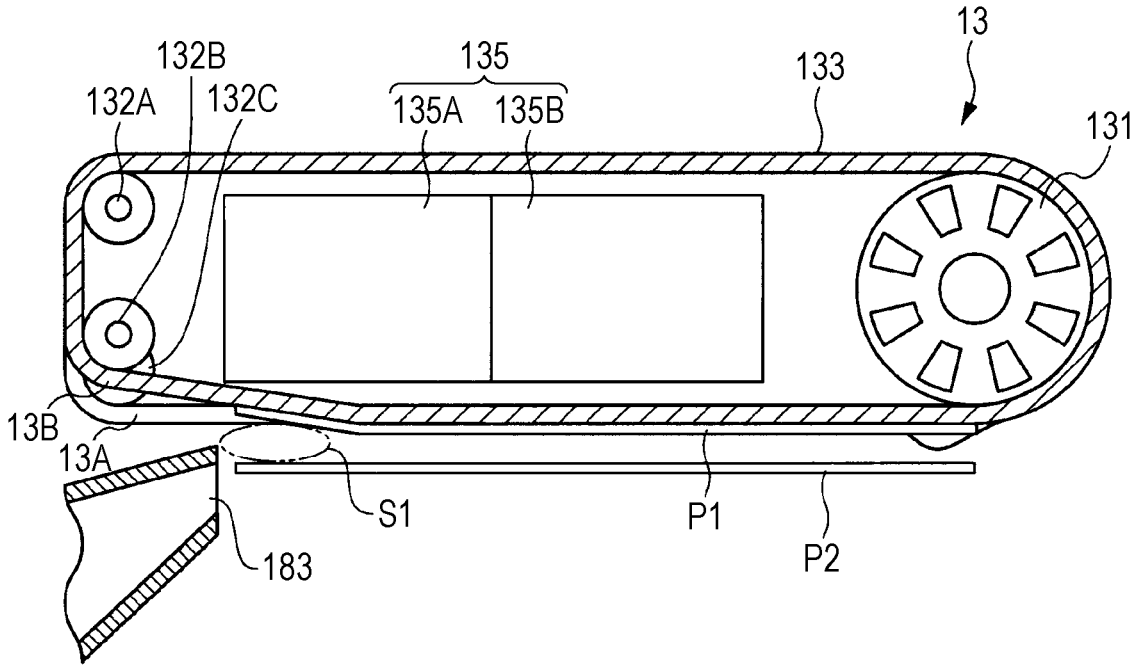
FIG. 5 is a cross-sectional view of the sheet feeding device according to an exemplary embodiment of the present invention, showing a sheet of paper sucked against a suction conveyor.
Figure 6:
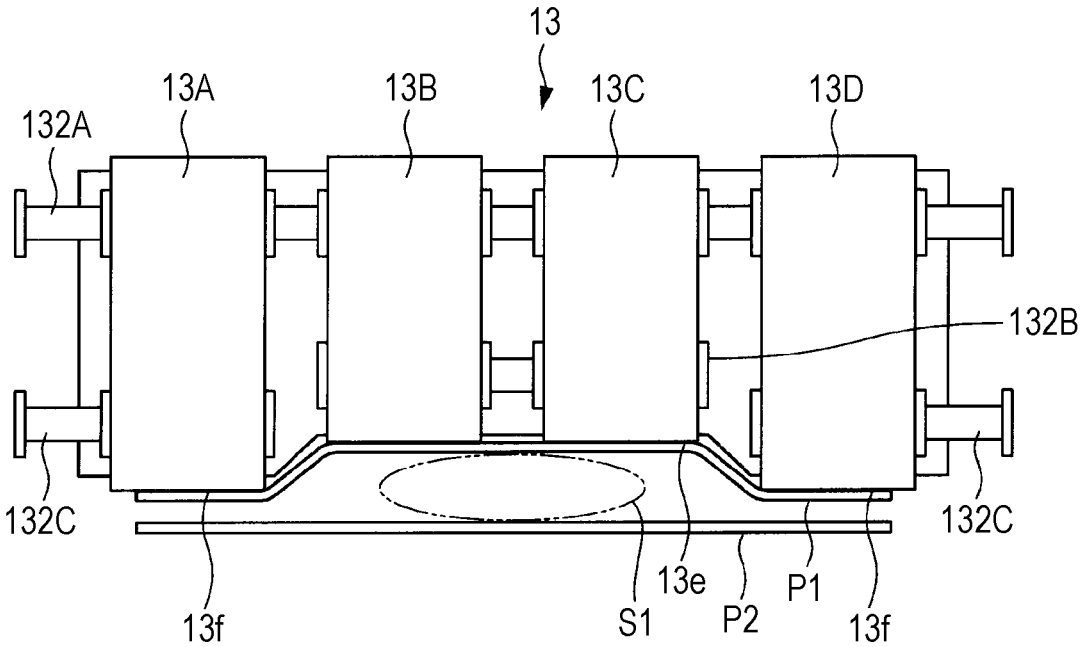
FIG. 6 is a front view of the sheet feeding device according to an exemplary embodiment of the present invention, showing a sheet of paper sucked against the suction conveyor viewed from a downstream side in a conveyance direction.

FIG. 5 is a cross-sectional view showing a sheet of paper sucked against the suction conveyor 13, and FIG. 6 is a front view showing a sheet of paper sucked against the suction conveyor 13 viewed from the downstream side in the conveyance direction.

As shown in FIGS. 5 and 6, the first conveyor part 13A and the fourth conveyor part 13D are disposed on both sides in the width direction (direction of arrow Y in FIG. 1) of the sheets of paper P. The second conveyor part 13B and the third conveyor part 13C are disposed between the first conveyor part 13A and the fourth conveyor part 13D. It should be noted that the first conveyor part 13A and the fourth conveyor part 13D have the same configuration, and the second conveyor part 13B and the third conveyor part 13C have the same configuration.

The first conveyor part 13A, the second conveyor part 13B, the third conveyor part 13C, and the fourth conveyor part 13D each has an endless suction belt 133. The suction belts 133 have a large number of small radius through holes 134 formed therein. Additionally, the suction belts 133 of the first conveyor part 13A, the second conveyor part 13B, the third conveyor part 13C, and the fourth conveyor part 13D are wound around a driving roller 131 that is connected to a drive source.

The driving roller 131 is disposed on the upstream side in the conveyance direction (X direction) of the sheets of paper P. A plurality of driven rollers 132A, 132B, 132C are disposed away from the driving roller 131 by a predetermined distance in the conveyance direction (X direction) of the sheets of paper P.

An upper driven roller 132A extends along the width direction of the sheets of paper P. The suction belts 133 of the first conveyor part 13A, the second conveyor part 13B, the third conveyor part 13C, and the fourth conveyor part 13D are wound around the upper driven roller 132A.

A first lower driven roller 132B is disposed vertically opposite the upper driven roller 132A. The first lower driven roller 132B is disposed in an intermediate portion in the width direction of the sheets of paper P. The suction belts 133 of the second conveyor part 13B and the third conveyor part 13C are wound around the first lower driven roller 132B.

Second lower driven rollers 132C are disposed vertically opposite the upper driven roller 132A. The second lower driven rollers 132C are disposed on both sides in the width direction of the sheets of paper P. The suction belts 133 of the first conveyor part 13A and the fourth conveyor part 13D are wound around the second lower driven rollers 132C.

Additionally, a suction device 135 is disposed inside the suction belts 133. The suction device 135 sucks the sheets of paper P from above through the through holes 134 formed in the suction belts 133. That is, the suction conveyor 13 conveys each sheet of paper P toward the pair of conveyance rollers 17A, 17B, to be described later, by the suction belts 133 while sucking the sheet of paper P against the suction belts 133 by the suction device 135.

The suction device 135 is divided into two suction ducts 135A, 135B along the conveyance direction (X direction) of the sheets of paper P. The suction device 135 is switchable between sucking the sheets of paper P with only the suction duct 135A and sucking the sheets of paper P with both the suction ducts 135A, 135B.

Additionally, the second lower driven rollers 132C are disposed vertically lower than the first lower driven roller 132B, that is, in a position approaching the stacked sheets of paper P. Thus, the downstream sides of the second conveyor part 13B and the third conveyor part 13C in the conveyance direction of the sheets of paper P are disposed vertically higher than the downstream sides of the first conveyor part 13A and the fourth conveyor part 13D in the conveyance direction of the sheets of paper P. Consequently, a recess 13*e* that is recessed vertically upward is formed on the downstream side in the conveyance direction and in the intermediate portion in the width direction of the suction conveyor 13. Additionally, horizontal portions 13*f* are formed by the first conveyor part 13A and the fourth conveyor part 13D on both ends in the width direction. The recess 13*e* is recessed vertically above the horizontal portions 13*f*.

Both ends of the sheet of paper P in the width direction are thus sucked against the horizontal portions 13*f*. An intermediate portion of the sheet of paper P in the width direction fits into the recess 13*e*, and is further sucked against the second conveyor part 13B and the third conveyor part 13C to be curved vertically upward. That is, the sheet of paper P undulates in the intermediate portion in the width direction due to the recess 13*e* formed by the second conveyor part 13B and the third conveyor part 13C.

Furthermore, a gap (air pocket) 51 is formed between a top sheet of paper P1 and a second sheet of paper P2 of the stacked sheets of paper P on the downstream side in the conveyance direction and in the intermediate portion in the width direction of the suction conveyor 13. The top sheet of paper P1 and the second sheet of paper P2 are separated by the air from the air discharge portions 183 of the front end blower 18 being blown into this gap 51.

Figure 7:
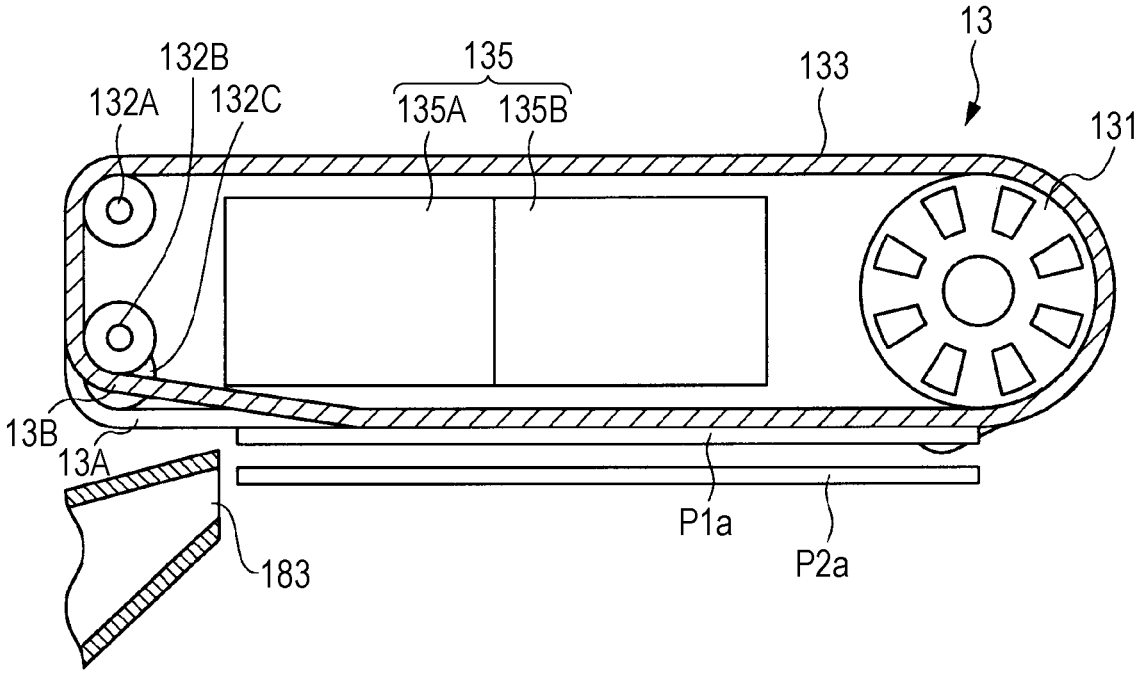
FIG. 7 is a cross-sectional view of the sheet feeding device according to an exemplary embodiment of the present invention, showing a sheet of paper sucked against the suction conveyor.
Figure 8:
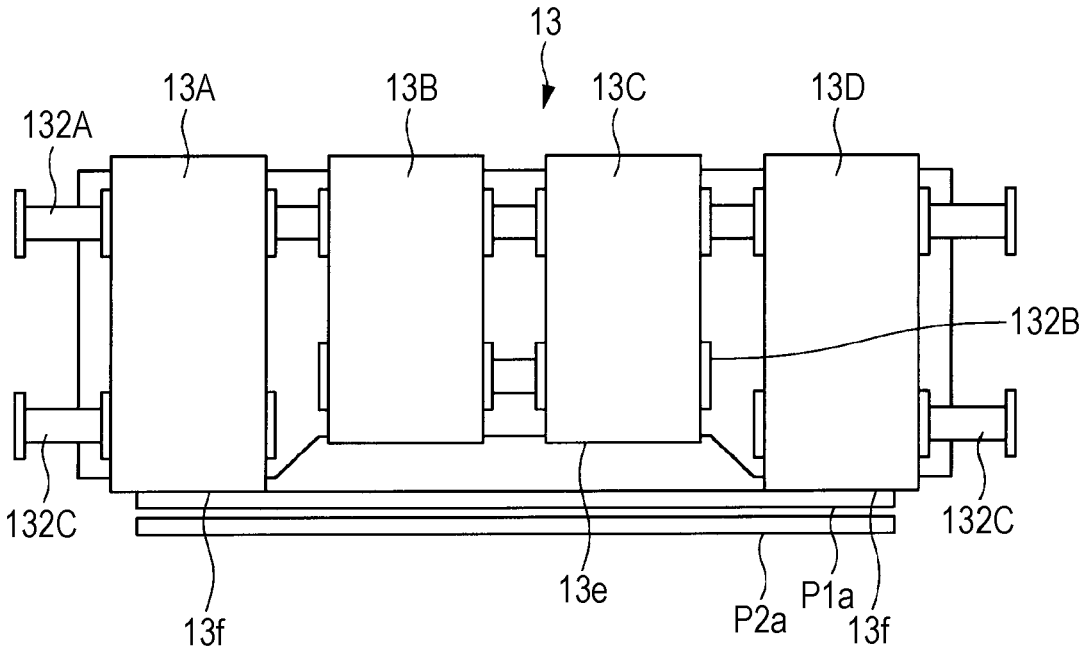
FIG. 8 is front view of the sheet feeding device according to an exemplary embodiment of the present invention, showing a sheet of paper sucked against the suction conveyor viewed from the downstream side in the conveyance direction.

FIGS. 7 and 8 are diagrams showing a sheet of thick paper with high stiffness sucked against the suction conveyor 13.

As shown in FIGS. 7 and 8, when a sheet of thick paper with high stiffness is sucked against the suction conveyor 13, a top sheet of paper P1*a* does not undulate in the intermediate portion in the width direction. Thus, no gaps (air pockets) are created between the top sheet of paper P1*a* and a second sheet of paper P2*a*, and a so-called double feed may occur in which the second sheet of paper P2*a* is conveyed together with the first sheet of paper P1*a*. For this purpose, in the sheet feeding device 10 of the present example, the regulating member 50 is provided on a first sheet conveyance guide member 22A and a second sheet conveyance guide member 22B, to be described later.

As shown in FIGS. 3 and 4, the first sheet conveyance guide member 22A and the second sheet conveyance guide member 22B are provided on the downstream side in the conveyance direction (X direction) of the suction conveyor 13. The first sheet conveyance guide member 22A and the second sheet conveyance guide member 22B are disposed vertically opposite each other. That is, the first sheet conveyance guide member 22A is disposed vertically upward, and the second sheet conveyance guide member 22B is disposed vertically downward.

The first conveyance roller 17A is rotatably mounted on the first sheet conveyance guide member 22A. The second conveyance roller 17B is rotatably mounted on the second sheet conveyance guide member 22B. The first conveyance roller 17A and the second conveyance roller 17B are disposed vertically opposite each other to form a nip. The sheet of paper P conveyed from the suction conveyor 13 is guided by the first sheet conveyance guide member 22A and the second sheet conveyance guide member 22B and directed toward the nip of the conveyance rollers 17A, 17B. The sheet of paper P is then discharged outside the sheet feeding device 10 by the conveyance rollers 17A, 17B.

Additionally, a conveyance sensor 27 is disposed in the vicinity (i.e., the first sheet conveyance guide member 22A) of the downstream side of the first conveyance roller 17A in the sheet conveyance direction. The conveyance sensor 27 detects the passage of the sheet of paper P conveyed by the conveyance rollers 17A, 17B. The conveyance sensor 27 outputs the detected signal to the controller 28 shown in FIG. 2.

The regulating member 50 that projects toward the upstream side in the conveyance direction (direction of arrow X in FIG. 2) is fixed to an end portion of the second sheet conveyance guide member 22B on the upstream side in the conveyance direction. The regulating member 50 is disposed on the second sheet conveyance guide member 22B in an intermediate portion in the width direction of the sheets of paper P. The regulating member 50 is disposed fixed to the second sheet conveyance guide member 22B above the opening 14*a* on the vertically upper end portion of the front end regulating member 14. That is, the regulating member 50 is disposed near the exit 182*a* of the duct 182 on which the air discharge portions 183 of the front end blower 18 are formed.

The regulating member 50 is fixed to the second sheet conveyance guide member 22B by an attachment pin 51. The regulating member 50 projects vertically upward from the end portion of the second sheet conveyance guide member 22B to a predetermined height. A regulating surface 50*a* of the regulating member 50 faces the stacked sheets of paper P and an outlet of the sheets of paper P of the suction conveyor 13. Among the sheets of paper P conveyed by the suction conveyor 13, the sheets of paper that are conveyed next, that is, the subsequent sheets of paper P abut the regulating surface 50*a* of the regulating member 50. The conveyance of the subsequent sheets of paper P is thus regulated by the regulating member 50 to ensure prevention of double feeds even when conveying sheets of thick paper.

When the first sheet of paper P is conveyed, the next sheet of paper P moves vertically upward due to the suction conveyor 13 and is sucked against the suction conveyor 13. The regulating surface 50*a* of the regulating member 50 is accordingly formed to be substantially parallel to the vertical direction, that is, the direction in which the sheets of paper P are sucked by the suction conveyor 13. Alternatively, the regulating surface 50*a* of the regulating member 50 is formed such that an upper end portion thereof tilts toward the downstream side in the conveyance direction.

This prevents the next sheet of paper P from getting caught on the regulating surface 50*a* of the regulating member 50 when the first sheet of paper P is conveyed and the next sheet of paper P moves vertically upward. In other words, the regulating member 50 regulates only the movement toward the conveyance direction of the sheet of paper P to be conveyed next but not its vertical movement. As a result, the sheet of paper P to be conveyed next is smoothly sucked against the suction conveyor 13.

1-2. Dimensions of the Regulating Member

The dimensions of the regulating member 50 having the above configuration will now be described with reference to FIGS. 9 and 10. A lower limit of a projection height of the regulating member 50 from the second sheet conveyance guide member 22B in FIG. 9 is first described.

Figure 9:
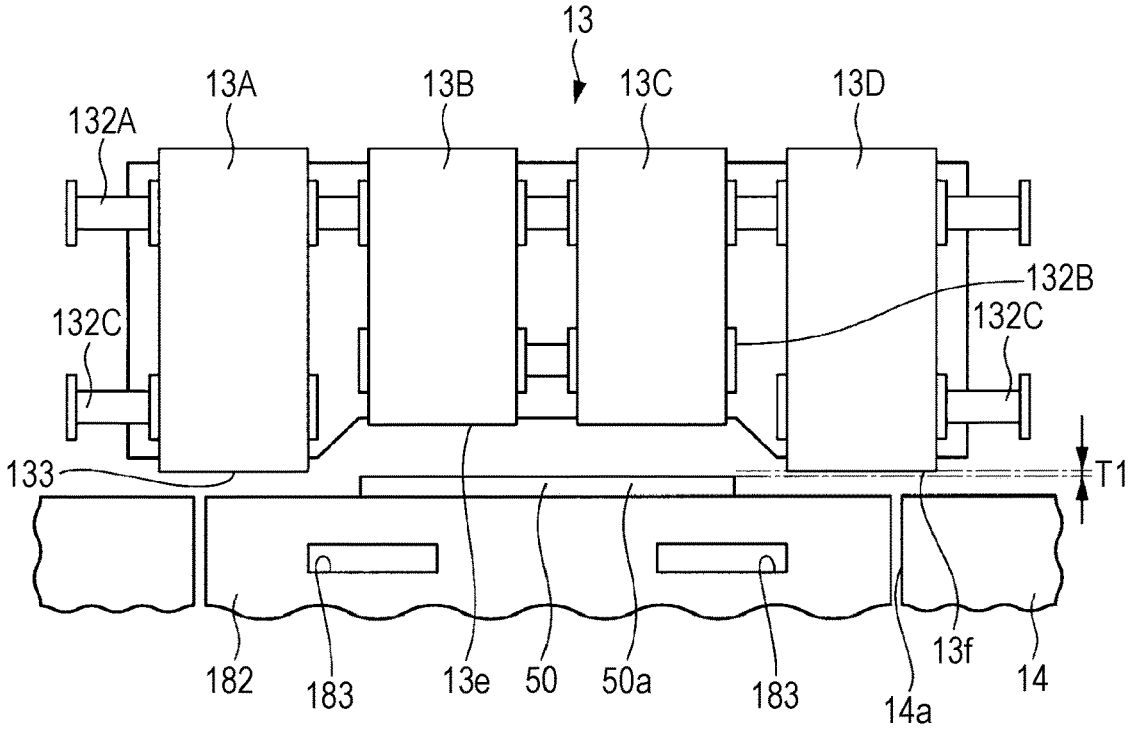
FIG. 9 is a front view of the sheet feeding device according to an exemplary embodiment of the present invention, showing a lower limit of a projection height of a regulating member.

FIG. 9 is a diagram showing the lower limit of the projection height of the regulating member 50. FIG. 10 is a diagram showing an upper limit of the projection height of the regulating member 50.

As shown in FIG. 9, the lower limit of the projection height of the regulating member 50 is set so that a gap T1 between an upper end portion of the regulating member 50 and the suction belts 133 of the first conveyor part 13A and the fourth conveyor part 13D is less than twice the thickness of the sheets of paper P to be conveyed. That is, the gap T1 between the upper end portion of the regulating member 50 and the horizontal portions 13*f*, which are the parts where the suction conveyor 13 does not form an undulation in the sheets of paper P, is set to be narrower than the thickness of two sheets of paper P. This allows only the first sheet of paper P to be passed through the gap T1 and ensures that the second sheet of paper P abuts against the regulating member 50.

It should be noted that in the example shown in FIG. 9, the length of the regulating member 50 in the width direction may be longer than the length of the recess 13*e* of the suction conveyor 13 in the width direction.

The length in the width direction and the upper limit of the projection height of the regulating member 50 are next described with reference to FIG. 10.

Figure 10:
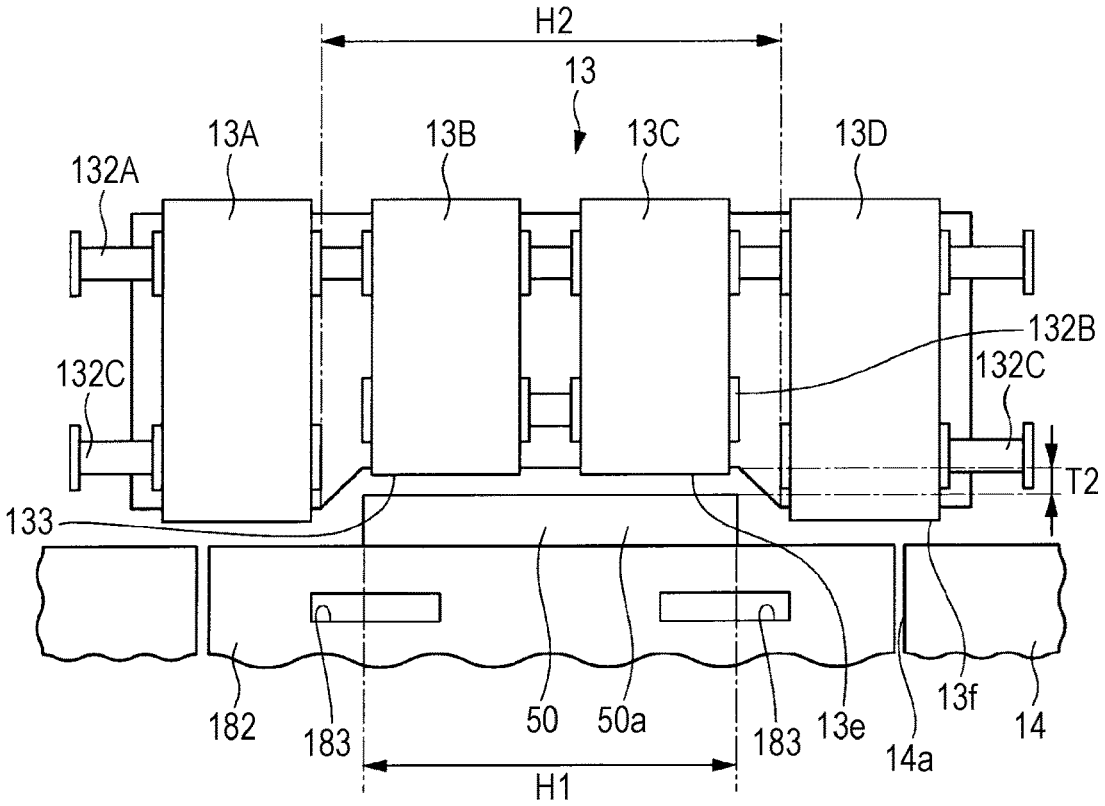
FIG. 10 is a front view of the sheet feeding device according to an exemplary embodiment of the present invention, showing an upper limit of the projection height of the regulating member.

FIG. 10 is a diagram showing the upper limit of the projection height of the regulating member 50.

It should be noted that, as shown in FIG. 10, a length H1 of the regulating member 50 in the width direction may be shorter than a length H2 of the recess 13*e* of the suction conveyor 13 in the width direction. In this case, the projection height of the regulating member 50 may be higher than the horizontal portions 13*f* of the suction conveyor 13. A portion of the regulating surface 50*a* of the regulating member 50 thus faces the recess 13*e* of the suction conveyor 13. This ensures that the second sheet of paper P abuts against the regulating member 50.

The upper limit of the projection height of the regulating member 50 is set so that a vertical gap T2 between the upper end portion of the regulating member 50 and the recess 13*e* of the suction conveyor 13 that forms an undulation is wider than the thickness of one sheet of paper P. This allows only the first sheet of paper P to be passed through the gap T2 while regulating the second sheet of paper P with the regulating member 50.

Although in the sheet feeding device 10 above, an example is described in which the regulating member 50 is fixed to the end portion of the second sheet conveyance guide member 22B, this should not be construed as a limitation. For example, the regulating member 50 may be vertically movably attached to the end portion of the second sheet conveyance guide member 22B. This enables a user to adjust the projection height of the regulating member 50. The regulating member 50 may be moved vertically either manually by a user or automatically by providing a drive source.

1-3. Example Operation for Adjusting the Projection Height of the Regulating Member An example operation for adjusting the projection height of a vertically movable regulating member 50 will now be described with reference to FIG. 11.

Figure 11:
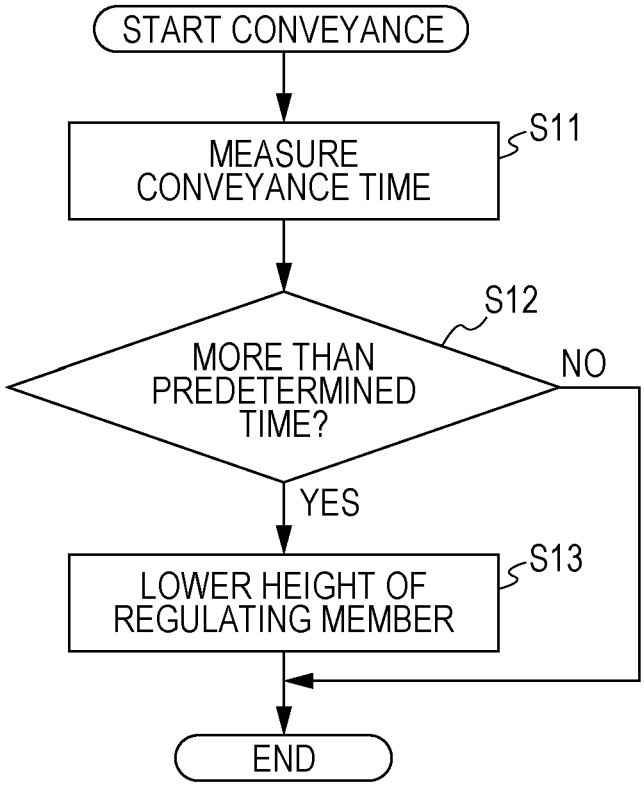
FIG. 11 is a flow chart showing projection height adjustment control of the regulating member of the sheet feeding device according to an exemplary embodiment of the present invention.

FIG. 11 is a flow chart showing the example operation for adjusting the projection height of the regulating member 50.

In the example operation shown in FIG. 11, the regulating member 50 is configured to be vertically movable with respect to the second sheet conveyance guide member 22B due to a movable member that has a drive source not shown. The controller of the sheet feeding device 10 measures the conveyance time of the sheet of paper P based on a detection signal detected by the conveyance sensor 27 (step S11). If the projection height of the regulating member 50 is high and the conveyed sheet of paper P rubs against the regulating member 50, the conveyance time of the sheet of paper P will be long.

Next, the controller determines whether the measured conveyance time is a predetermined time or more (step S12). In step S12, when the controller determines that the conveyance time is less than a predetermined time (NO determination in step S12), the controller conveys the next sheet of paper P and the operation is completed.

When the projection height of the regulating member 50 is high and the conveyed sheet of paper P rubs against the regulating member 50, the conveyance time of the sheet of paper P will be longer than the normal conveyance time in which the sheet of paper P does not rub against the regulating member 50. Thus, in step S12, if the controller determines that the conveyance time is a predetermined time or more (YES determination in step S12), the controller drives the movable member not shown to lower the projection height of the regulating member 50 (step S13). The controller then causes the next sheet of paper P to be conveyed. The sheet feeding device 10 adjusts the projection height of the regulating member 50 by repeating the processes described above. This enables the conveyance process of the subsequent sheets of paper P to be performed smoothly.

It should be noted that in step S13, the controller does not lower the projection height of the regulating member 50 to lower than the lower limit shown in FIG. 9.

2. EXAMPLE CONFIGURATION OF AN IMAGE FORMING APPARATUS

Figure 12:
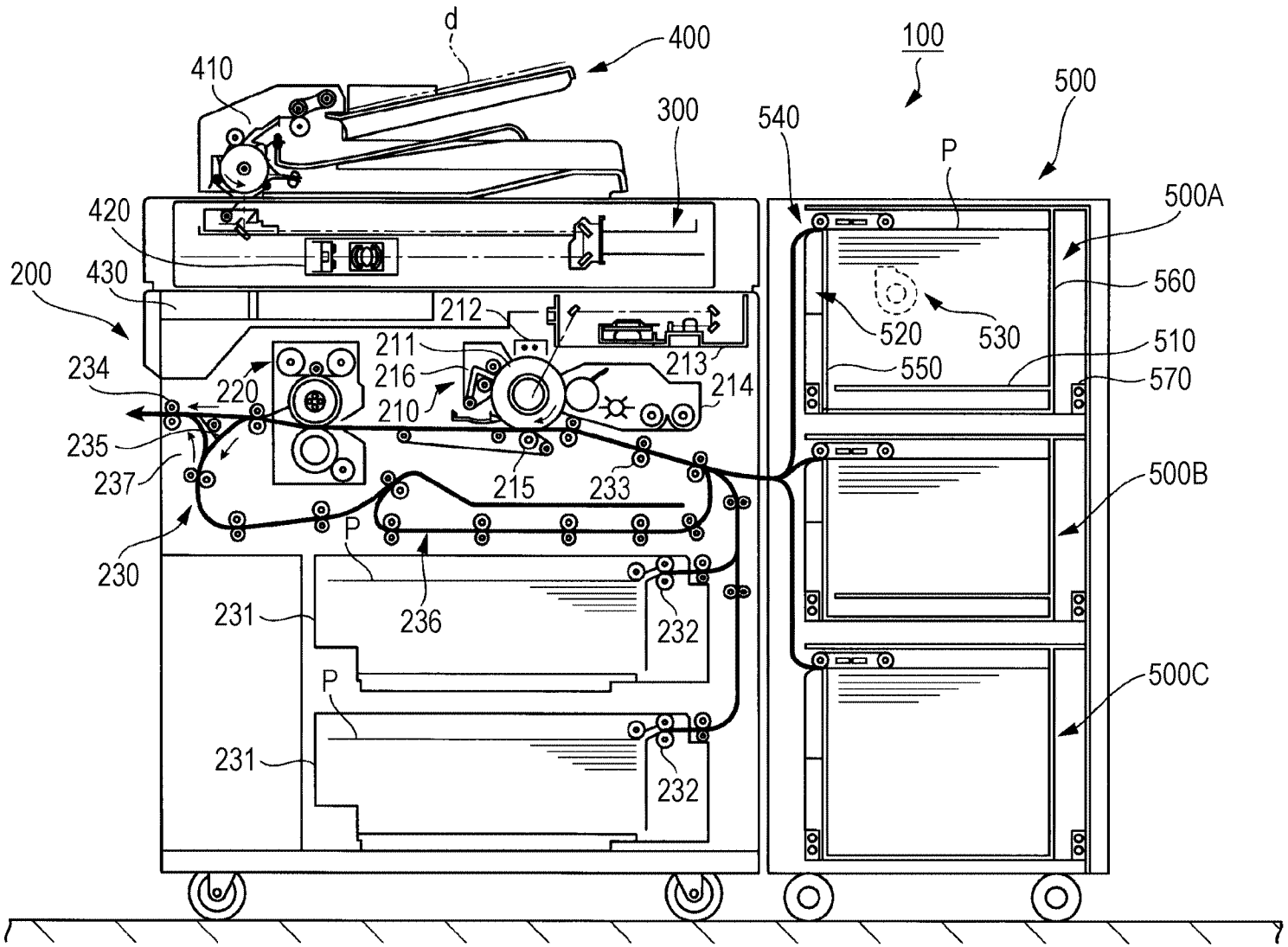
FIG. 12 is an overall configuration view showing an example of an image forming apparatus using the sheet feeding device according to an exemplary embodiment of the present invention.

FIG. 12 is an overall configuration view showing an example of an image forming apparatus using the sheet feeding device having the configuration described above.

The sheet feeding device 10 of the present example described above is suitable as a sheet feeding device for feeding sheets of paper to an image forming apparatus. Examples of the image forming apparatus using the sheet feeding device 10 of the present example includes a copying machine, a printing apparatus, a facsimile apparatus, a printing press, and a multi-function machine. An image forming apparatus (an image forming apparatus of the present invention) that uses the sheet feeding device 10 according to the embodiment will now be described with reference, for example, to a copying machine.

As shown in FIG. 12, an image forming apparatus 100 includes an image forming apparatus body 200, an image reading device 300, an automatic document feeding device 400, and a sheet feeding device 500.

The image forming apparatus body 200 has an image former 210, a fixing unit 220, and a sheet conveying unit 230. In this image forming apparatus body 200, the image former 210 includes, for example, a photoconductor 211, a charge unit 212, an exposure unit 213, a developing unit 214, a transfer unit 215, and a cleaning unit 216.

The photoconductor 211 is an image carrier and is driven to rotate by a drive source not shown. The charge unit 212 applies an electric charge to the photoconductor 211 to uniformly charge the surface of the photoconductor 211. The exposure unit 213 exposes the surface of the photoconductor 211 based, for example, on image data read from a document d to form an electrostatic latent image on the photoconductor 211.

The developing unit 214 develops the electrostatic latent image formed on the photoconductor 211 using a two-component developing agent containing a toner and a carrier to create a toner image. The transfer unit 215 transfers the toner image on the photoconductor 211 to a sheet of paper P that is conveyed by the sheet conveying unit 230. The cleaning unit 216 removes the toner remaining on the photoconductor 211, in other words, cleans the surface of the photoconductor 211.

The sheet conveying unit 230 includes a paper cassette 231, a first sheet feeding unit 232, a second sheet feeding unit 233, a sheet discharge unit 234, a conveyance path switching unit 235, a circulative re-feeding unit 236, and an inverting discharge unit 237.

The document d placed on a document holder of the automatic document feeding device 400 is conveyed to the image reading device 300 by a sheet feeding unit 410. An image on one or both sides of the document d conveyed to the image reading device 300 is exposed by an optical system and read by an image sensor 420. An analog signal photoelectrically converted by the image sensor 420 is subjected to various processes in an image processing unit 430 such as an analog process, an analog to digital conversion process, a shading correction process, and an image compression process. The image signal subjected to the various signal processes is sent to the exposure unit 213 from the image processing unit 430.

In the image former 210, the surface of the photoconductor 211 is charged by the charge unit 212, then irradiated with laser light from the exposure unit 213 to form the electrostatic latent image, which is visualized by the developing unit 214 to create the toner image. Subsequently, the sheet of paper P contained in the paper cassette 231 is conveyed by the first sheet feeding unit 232. The sheet of paper P is conveyed synchronized with the toner image at the second sheet feeding unit 233 which is composed of resist rollers. The toner image is then transferred to the sheet of paper P at the transfer unit 215 after which the toner image is fixed by the fixing unit 220.

After fixing, the sheet of paper P is discharged outside the image forming apparatus body 200 by the sheet discharge unit 234. Meanwhile, the toner remaining on the photoconductor 211 after the transfer is removed by the cleaning unit 216. When making duplex copies, the sheet of paper P which has an image formed on a first surface is sent to the circulative re-feeding unit 236 to be inverted, and after an image is formed again in the image former 210 on a second surface, the sheet of paper P is discharged outside the image forming apparatus body 200 by the sheet discharge unit 234. When the sheet of paper P is to be discharged inverted, the sheet of paper P diverged from the usual discharge path has its direction reversed and is turned upside down in the inverting discharge unit 237, and thereafter is discharged outside the image forming apparatus body 200 by the sheet discharge unit 234.

The sheet feeding device 500 is connected to the image forming apparatus body 200, and is an air suction sheet feeding device that feeds the sheets of paper P to the image forming apparatus body 200 while separating them from one another by blowing air thereonto.

The sheet feeding device 500 according to the present example includes, for example, three tiers of sheet feeding units 500A, 500B, 500C that each have a paper tray 510, and is a large capacity sheet feeding device that is capable of housing a large number of the sheets of paper P. The three tiers of sheet feeding units 500A, 500B, 500C basically have the same configuration. Accordingly, the schematic configuration of the uppermost sheet feeding unit 500A will be described.

The sheet feeding unit 500A includes, other than the paper tray 510, for example, a front end blower 520, a side blower 530, a suction conveyor 540, a front end regulating member 550, a rear end regulating member 560, and a guide rail 570. The paper tray 510 is configured to be capable of being pulled out from the sheet feeding device 500 by the guide rail 570.

In the image forming apparatus 100 of the above configuration, the sheet feeding device 10 according to the embodiment described above can be used as the sheet feeding device 500, more specifically, as each of the sheet feeding units 500A, 500B, 500C of the sheet feeding device 500. Among the main components in FIGS. 1, 2, and 12, the front end blower 520 corresponds to the front end blower 18, the side blower 530 to the side blower not shown, and the suction conveyor 540 to the suction conveyor 13.

Although a copying machine has been described as an example of the image forming apparatus 100 that uses the sheet feeding device 10 according to the embodiment described above, this application should not be regarded as limiting. That is, the present invention can be applied to image forming apparatuses in general that are provided with air suction sheet feeding devices having air blowing mechanisms, such as a printing apparatus, a facsimile apparatus, a printing press, and a multi-function machine.

The sheet feeding device 10 may also be applied to the paper cassette 231 of the image forming apparatus body 200 to obtain similar effects.

3. OTHERS

In the above exemplary embodiments, an example has been described of the image forming apparatus applied to an image forming apparatus that forms monochrome images, but it may be applied to an image forming apparatus that forms color images.

In the above exemplary embodiments, an example has been described in which the regulating member 50 is fixed to the second sheet conveyance guide member 22B, but this should not be construed as a limitation. The regulating member may be configured, for example, such that the end portion of the second sheet conveyance guide member 22B on the upstream side in the conveyance direction is projected vertically upward.

Additionally, in the above exemplary embodiments, an example has been described in which the projection height of the regulating member 50 is adjusted by vertically moving the regulating member 50, but this should not be construed as a limitation. For example, the space between the upper end portion of the regulating member 50 and the recess 13*e* of the suction conveyor 13 can be adjusted by vertically moving the second conveyor part 13B and the third conveyor part 13C that form the recess 13*e* of the suction conveyor 13.

Although an example has been described in which the regulating member 50 is provided on the end portion of the second sheet conveyance guide member 22B on the upstream side in the conveyance direction, this should not be construed as a limitation. It is only required that the regulating member 50 is disposed between the end portion of the second sheet conveyance guide member 22B on the upstream side in the conveyance direction and the second conveyance roller 17B.

Furthermore, the regulating member 50 is not limited to the example of being fixed to the second sheet conveyance guide member 22B, but may be provided, for example, on the duct 182 of the front end blower 18. That is, it is only required that the regulating member 50 is provided projecting vertically upward in a position that faces the outlet of the sheets of paper P of the suction conveyor 13 on the downstream side of the suction conveyor 13 in the conveyance direction.

In the above exemplary embodiments, motor (DC motor) and clutch systems have been described as the drive system for the suction belts 133 and the rollers of the suction conveyor 13, but other drive systems such as stepping motors may also be used.

Additionally, the present invention is not limited to the above exemplary embodiments, and it is to be understood that the present invention may assume various alternative applications and variations without departing from the spirit and scope of the invention set forth in the appended claims.

For example, although the configurations of the devices and systems of the above exemplary embodiments have been described in detail and with particularity to help illustrate the present invention, the present invention is not necessarily limited to embodiments having all of the configurations described.

Additionally, the above-described configurations, functions, processing units, processing means, and the like may be implemented, in part or in whole, in hardware, for example, by designing with an integrated circuit. Furthermore, the above-described configurations, functions, and the like, may be implemented in software by a processor interpreting and implementing a program that implements the functions. Information such as programs, tables, and files that implement the functions can be stored in recording devices such as a memory, a hard disk, or a solid state drive (SSD), or in recording media such as an IC card, an SD card, or a DVD.

It should be noted that terms such as "parallel" and "orthogonal" used herein do not imply only "parallel" and "orthogonal" in the strict sense, but includes "parallel" and "orthogonal," and also "substantially parallel" and "substantially orthogonal" which are within the range that demonstrate "parallel" and "orthogonal."

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet feeding device comprising:

a stacker that stacks sheets of paper;

a suction conveyor disposed vertically above the sheets of paper stacked in the stacker for sucking and conveying the sheets of paper;

a blower that blows air onto the sheets of paper sucked by the suction conveyor; and a regulating member disposed on a downstream side of the suction conveyor in a conveyance direction, facing an outlet of the sheets of paper of the suction conveyor and projecting vertically upward, wherein the suction conveyor includes:

horizontal portions provided on both ends in a width direction orthogonal to the conveyance direction of the sheets of paper; and a recess provided in an intermediate portion in the width direction and recessed vertically above the horizontal portions, the recess including a vertical upper end portion which is at least partially horizontally flat, the recess extending to a downstream edge of the suction conveyor in the conveyance direction, and a lower limit of a projection height of the regulating member is set so that, when there is a vertical gap between a vertical upper end portion of the regulating member and the horizontal portions, a length of the gap is less than twice a thickness of the sheets of paper.

2. The sheet feeding device according to claim 1, wherein the regulating member is disposed in the intermediate portion in the width direction of the suction conveyor and has a length in the width direction shorter than a length of the recess in the width direction, and the upper end portion of the regulating member is disposed vertically above the horizontal portions.

3. The sheet feeding device according to claim 2, wherein an upper limit of the projection height of the regulating member is set so that a gap between the upper end portion and the recess is wider than the thickness of one of the sheets of paper.

4. The sheet feeding device according to claim 1, wherein a regulating surface of the regulating member facing the suction conveyor is formed parallel to a direction in which the sheets of paper are sucked by the suction conveyor.

5. The sheet feeding device according to claim 4, wherein the regulating surface of the regulating member facing the suction conveyor is formed such that a vertical upper end portion tilts toward the downstream side in the conveyance direction.

6. The sheet feeding device according to claim 1, wherein the regulating member is vertically movably provided.

7. The sheet feeding device according to claim 6, further comprising:

a conveyance sensor that detects conveyance of the sheets of paper; and a controller that measures a conveyance time of the sheets of paper based on a signal of the conveyance sensor and adjusts the projection height of the regulating member based on the conveyance time.

8. The sheet feeding device according to claim 1, wherein the suction conveyor is configured to be capable of varying a vertical height of the recess.

9. The sheet feeding device according to claim 1, wherein the vertical upper end portion of the recess includes a first horizontally flat conveyor and the horizontal portions include a second horizontally flat conveyor.

10. An image forming apparatus comprising:

an image former that forms an image on a sheet of paper; and a sheet feeding device that feeds the sheet of paper to the image former, wherein the sheet feeding device includes:

a stacker that stacks sheets of paper;

a suction conveyor disposed vertically above the sheets of paper stacked in the stacker for sucking and conveying the sheets of paper;

a blower that blows air onto the sheets of paper sucked by the suction conveyor; and a regulating member disposed on a downstream side of the suction conveyor in a conveyance direction, facing an outlet of the sheets of paper of the suction conveyor and projecting vertically upward, the suction conveyor includes:

horizontal portions provided on both ends in a width direction orthogonal to the conveyance direction of the sheets of paper; and a recess provided in an intermediate portion in the width direction and recessed vertically above the horizontal portions, the recess including a vertical upper end portion which is at least partially horizontally flat, the recess extending to a downstream edge of the suction conveyor in the conveyance direction, and a lower limit of a projection height of the regulating member is set so that, when there is a vertical gap between a vertical upper end portion of the regulating member and the horizontal portions, a length of the gap is less than twice a thickness of the sheets of paper.

11. The image forming apparatus according to claim 10, wherein the vertical upper end portion of the recess includes a first horizontally flat conveyor and the horizontal portions include a second horizontally flat conveyor.

* * * * *